United States Patent [19]

Lepley

[11] Patent Number: 4,629,367

[45] Date of Patent: Dec. 16, 1986

[54] RETAINING WALL

[75] Inventor: Donald M. Lepley, Youngstown, Ohio

[73] Assignee: Republic Steel Corporation, Cleveland, Ohio

[21] Appl. No.: 630,081

[22] Filed: Jul. 12, 1984

[51] Int. Cl.[4] ..... E02D 29/02

[52] U.S. Cl. ..... 405/284; 405/273; 405/276

[58] Field of Search ..... 405/273, 272, 284, 274, 405/276, 279, 258, 263

[56] References Cited

U.S. PATENT DOCUMENTS

| | | | |
|---|---|---|---|
| 839,608 | 12/1906 | Larssen | 405/276 |
| 2,092,646 | 9/1937 | Grother . | |
| 2,210,264 | 8/1940 | Schenk | 405/273 |
| 2,376,677 | 5/1945 | Flath | 405/273 |
| 3,614,870 | 10/1971 | Boynton | 405/273 |

FOREIGN PATENT DOCUMENTS

| | | | |
|---|---|---|---|
| 580712 | 10/1976 | Switzerland | 405/279 |

*Primary Examiner*—Dennis L. Taylor

*Attorney, Agent, or Firm*—Watts,Hoffmann,Fisher & Heinke Co.

[57] ABSTRACT

A bin-type retaining wall including at least one bin 10 defined by front and rear wall sections 12, 14 spaced apart by spacing walls 16, the bin providing a volume for anchoring material. Each wall section includes a plurality of longitudinal stringers 20, substantially hat-shaped in cross section and defined by a force receiving web 34 and a pair of outwardly diverging legs 32. Each leg terminates at an angled flange 36 having a portion **36*a* located in a vertical plane substantially parallel to the force receiving web and another portion 36*b* located in a plane that intersects the plane of the web. The flange portions 36*b* define abutting surfaces for adjacent stringers. Forces generated by the anchoring material, applied to the webs urge the legs outwardly to cause abutting contact between adjacent leg flange portions 36*b*, generating a soil tight interface between adjacent stringers. The spacers 24** are similarly configured and are also hat-shaped in cross section so that anchoring material produces soil tight abutting contact between exposed, adjacent spacers.

10 Claims, 6 Drawing Figures

RETAINING WALL

DESCRIPTION

1. Technical Field

The present invention relates generally to retaining walls and in particular to an improved construction for a bin-type retaining wall.

2. Background Art

Retaining walls are employed to shore a mass of earth to prevent or inhibit earth movement, erosion, etc. Bin-type structures for defining or forming retaining walls have become popular because they are economical to manufacture and install. Typically, this type of retaining wall consists of a plurality of "bins", alternately termed "cribs", located side by side to define an elongate wall. In general, each bin comprises an inner and outer wall section spaced apart by spacers to define a volume for receiving earth or other material. The bins are normally assembled on the site, attached together and then back filled with material, usually soil, which anchors the bins in position to provide a retaining wall. With this type of construction, footers or other anchoring devices are unnecessary since the weight of the earth in each bin acts as an anchor for the overall retaining wall.

Each bin must retain the back filled material in order for the bin to remain fixed and properly perform its retaining wall function. In some prior art constructions, the bins were not "soil tight" and as a result the back filled material gradually leaked out the front or exposed face of the wall. This leaking is especially troublesome in situations where the soil is finely granulated and/or in applications where the walls are exposed to large amounts of water from rain or other sources such as ground water. While attempts have been made to enhance soil retention prior retaining wall constructions which were not "soil tight" and allowed the anchoring material to escape ultimately resulting in instability of the retaining wall and requiring periodic back filling to replace the soil that escaped.

DISCLOSURE OF THE INVENTION

The present invention provides a new and improved bin-type retaining wall in which forces exerted by the anchoring material urge adjacent transverse members that make up the exposed face of the wall into substantially soil tight contact.

According to the preferred embodiment, the retaining wall includes at least one bin or wall unit that is defined by front and rear wall sections spaced apart by elements referred to as "spacers". At least one of the wall sections, comprises a plurality of transverse elements called "stringers" that extend between and are fastened to a pair of upright members. Each stringer is channel like in cross section, including a web section and a pair of legs extending outwardly from each side of the web section. The web section defines a region for receiving forces from the anchoring material inside the bin and each leg defines an oblique angle with respect to the web section.

According to the invention, each leg terminates in an angled flange. The flange is defined by a first portion that extends in a direction away from a center plane of the stringer. A second portion of the flange extends from the first portion towards a plane defined by the force receiving region of the web. The second flange portion defines an abutment surface which abuttably engages an abutment surface of an adjacent stringer flange.

During assembly the stringers are positioned side-by-side with the second flange portion of adjacent stringers in substantially abutting contact. In accordance with the invention, forces applied by the anchoring material to the web of each stringer, urge the legs outwardly and generates an internal pressure which tends to drive the second flange portions of adjacent stringers towards each other. As a result a relatively soil tight interface is generated between adjacent stringers.

Unlike the prior art, with the present invention, soil tight contact between adjacent stringers is achieved by utilizing forces generated by the anchoring material. The disclosed retaining wall construction reduces the number of separate fasteners needed for clamping adjacent stringers together to produce the soil tight fit. The disclosed construction is economical to both manufacture and install.

According to a feature of the invention, the angle defined between each stringer leg and its associated web is greater than 90° so that the stringer is hat-shaped in cross section. In accordance with this embodiment, the first flange portions of each stringer are coplanar, each being disposed in a plane substantially parallel to the plane defined by the web. In this embodiment, the second flange portion defines an angle of substantially 90° with respect to the first flange portion and is disposed in a plane that intersects the plane of the web at substantially 90°.

In the preferred and illustrated embodiment both the front and rear wall sections of the retaining wall are similarly constructed, each comprising a plurality of stringers embodying the present invention and positioned in a vertical juxtaposed relationship. According to a further feature of the invention, the spacers that maintain the spatial distance between the front and rear wall sections are substantially similar in construction to the stringers and also include the abutting flange construction for providing a soil tight interface.

With the disclosed construction, a relatively inexpensive soil tight retaining wall can be manufactured. More importantly, the soil tight interface is produced without requiring an excessive amount of fasteners hence reducing the overall installation time of the wall.

Additional features of the invention will become apparent and a fuller understanding obtained by reading the following detailed description made in connection with the accompanying drawings.

BEST MODE FOR CARRYING OUT THE INVENTION

Figure 1:
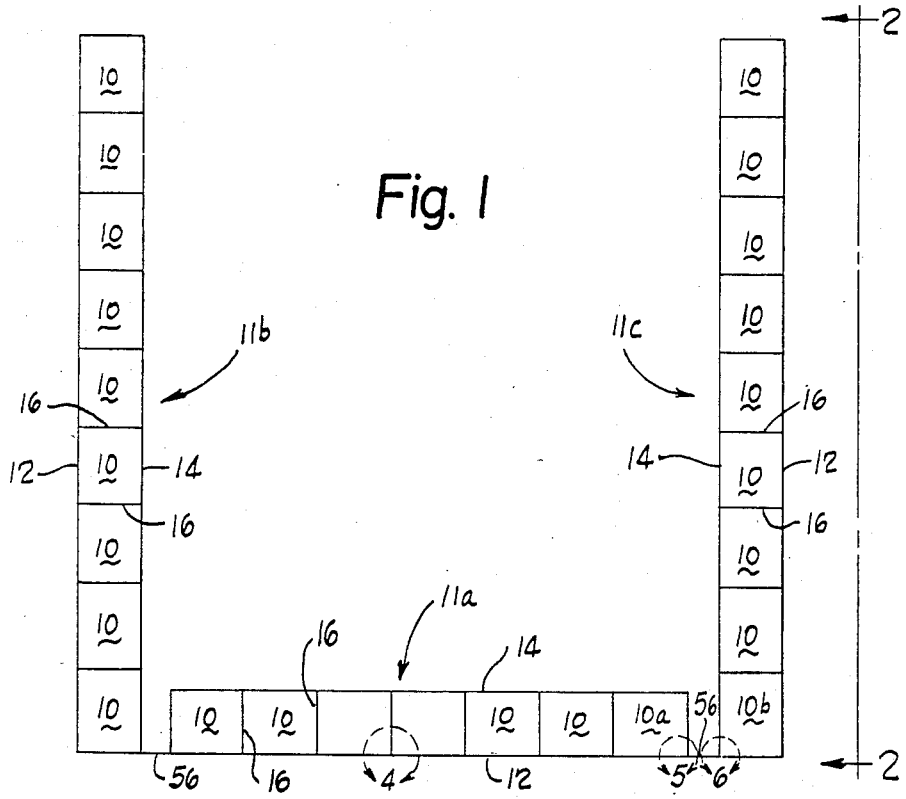
FIG. 1 is a top plan view of a retaining wall embodying the present invention.

FIG. 1 illustrates the overall construction of a retaining wall embodying the present invention. The wall comprises a plurality of "bins", alternately termed "cribs" 10, joined side by side to define a longitudinal wall. In the illustrated embodiment, the overall wall is substantially U-shaped in contour and comprises a center section 11*a* and spaced apart parallel leg sections 11*b*, 11*c* located at right angles to either end of the center section. It should be understood that the contour of the retaining wall is determined by the application and the invention itself is not to be limited to the shape disclosed herein.

Figure 2:
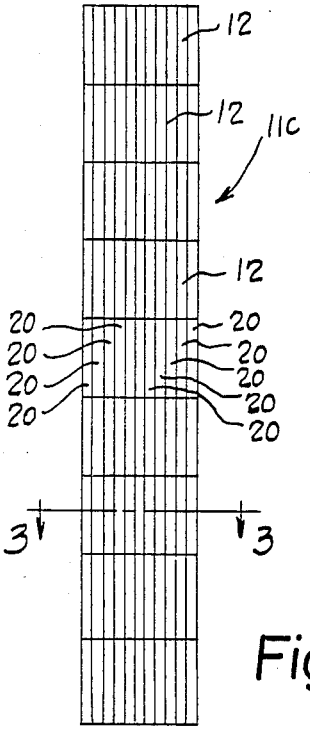
FIG. 2 is a side view of the wall as seen from the plane indicated by the line 2—2 in FIG. 1.
Figure 3:
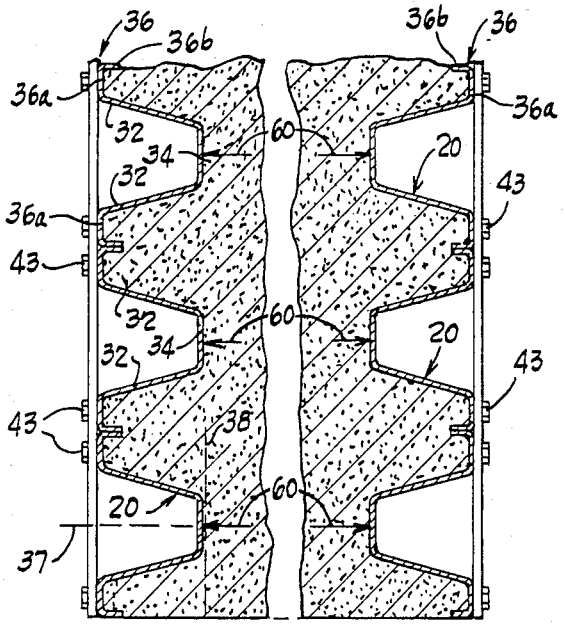
FIG. 3 is a fragmentary sectional view of the wall as seen from the plane indicated by the line 3—3 in FIG. 2, with parts omitted for clarity.

Each bin 10 includes an outer and inner wall 12, 14 spaced apart by transverse spacing walls 16. As seen best in FIG. 2, the inner and outer walls 12, 14 (only the outer wall 12 is shown in FIG. 2) each comprise a plurality of longitudinal members 20, stacked vertically in a side by side or juxtaposed relation. In the illustrated and preferred embodiment, the transverse spacing walls 16 each comprise a plurality of spacing members 24 (shown best in FIGS. 4–6), also stacked vertically in a juxtaposed relationship.

According to the invention, the longitudinal or "stringer" members 20 which form the inner and outer walls 12, 14 are arranged and configured such that forces generated during use urge the individual stringer members 20 into a sealing co-engagement with one another to inhibit leakage of soil or other material from the bin 10.

Referring to FIGS. 3–6, each stringer 20 is elongate and channel-like in construction. Each stringer forms a structural component of the wall and includes a pair of channel-like legs 32 extending at a predetermined angle from a web 34. In the preferred embodiment, the legs define an angle greater than 90° with the web 34. Each leg terminates in an L-shaped flange 36. When the stringer 20 is in its installed position, a portion 36*a* of the L-shaped flange is disposed in a substantially vertical plane whereas a portion 36*b* extends towards the web surface and is disposed in a substantially horizontal plane. Preferably, the flange portions 36*a*, 36*b* define an angle of substantially 90°. Said another way, the flange portion 36*a* extends from its associated leg 32 in a direction away from a center plane of the stringer (indicated by the phantom line 37 in FIG. 3); the flange portion 36*b* lies in a plane transverse to and displaced from the plane of the web 34, as indicated by the reference character 38.

Figure 4:
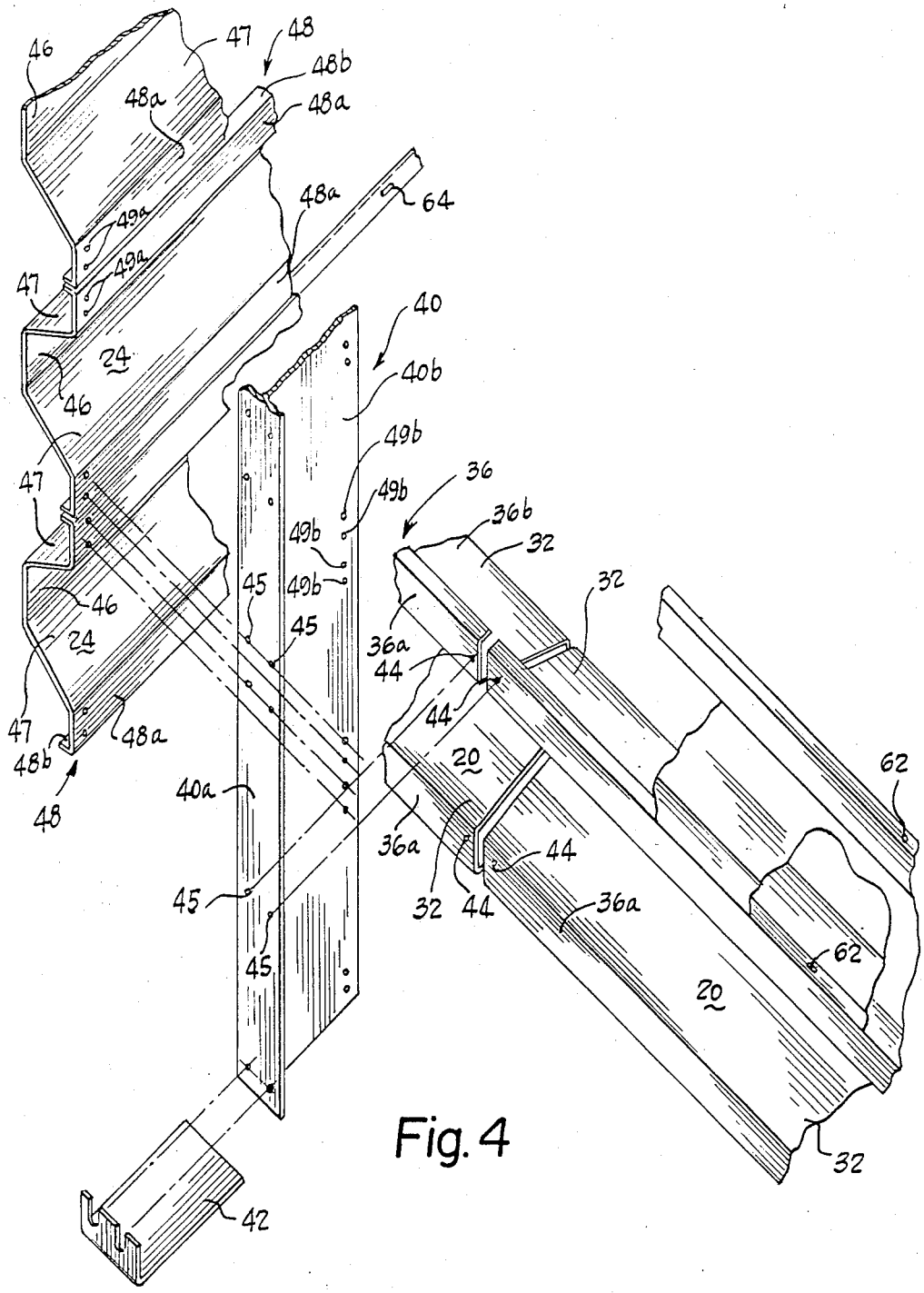
FIG. 4 is an enlarged, fragmentary, exploded view of a portion of the wall indicated by the circle 4 in FIG. 1.
Figure 5:
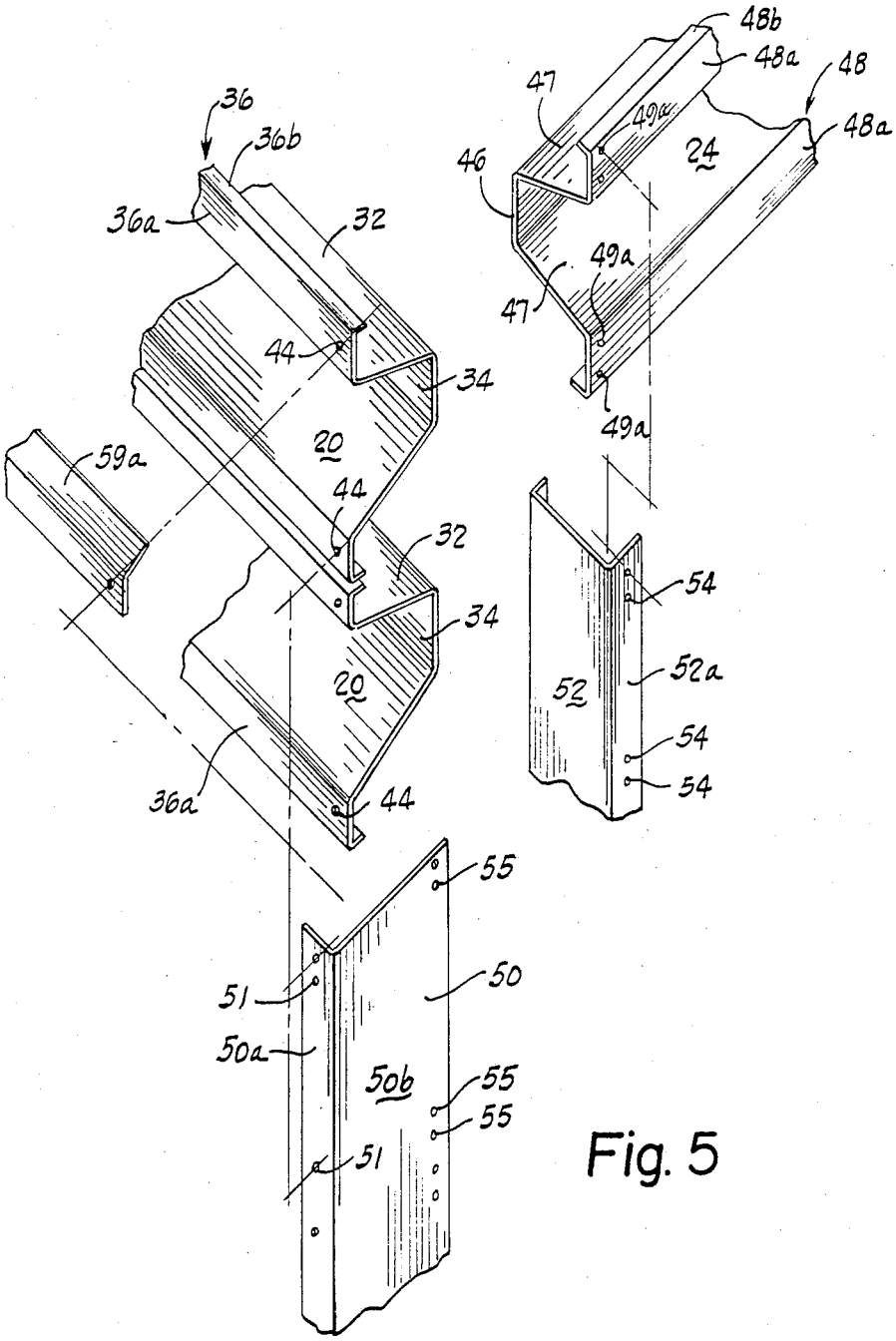
FIG. 5 is an enlarged, fragmentary exploded view of a portion of the wall indicated by the circle 5 in FIG. 1; and, FIG. 6 is an enlarged, fragmentary exploded view of a portion of the wall as indicated by the circle 6 in FIG. 1.
Figure 6:
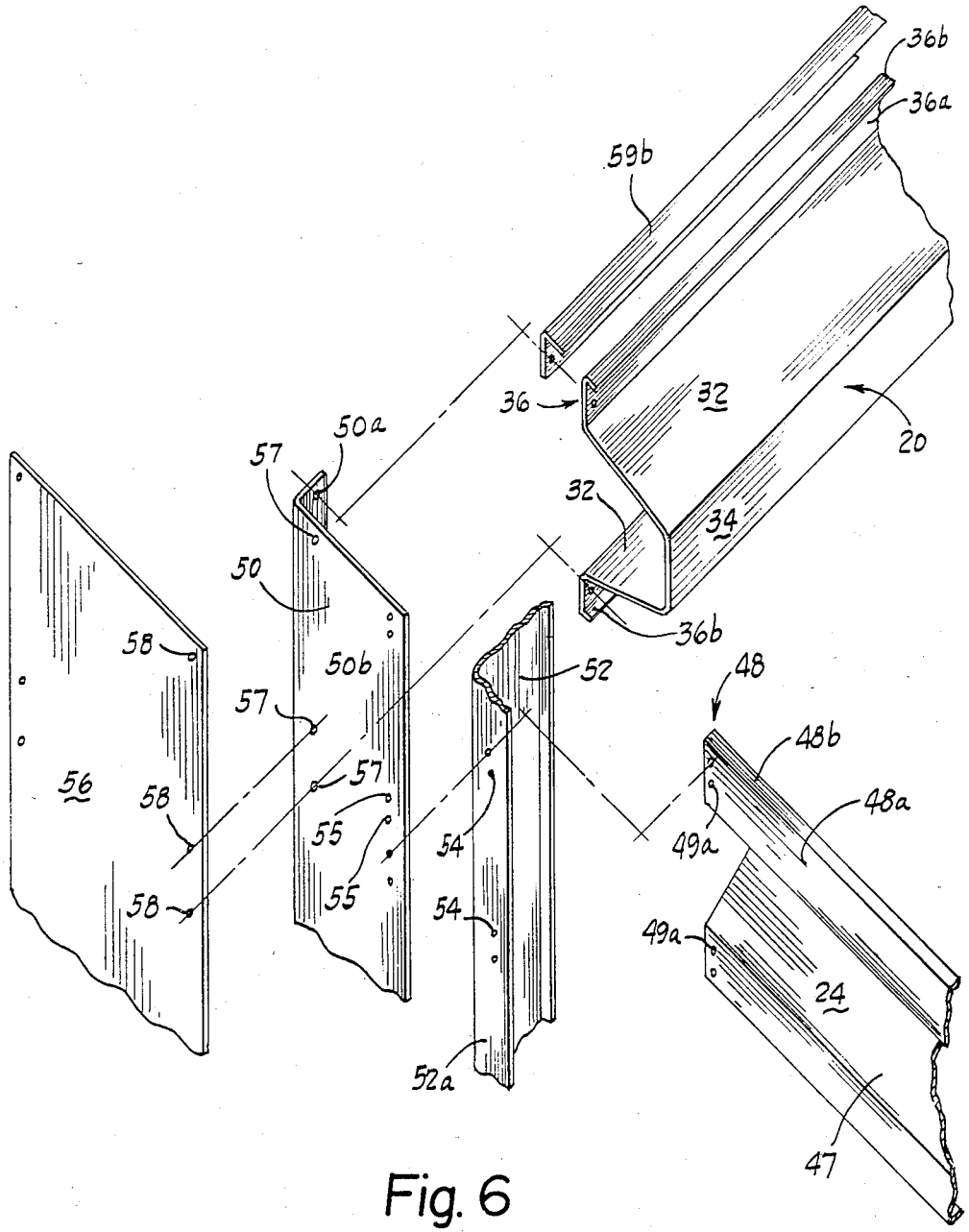

FIGS. 4–6 illustrate the various elements that comprise the overall retaining wall. The stringers 20 extend between vertically standing members. Referring in particular to FIG. 4, one vertically standing member comprises a T-column 40 which extends upwardly from a base plate 42 suitably fastened to the bottom of the column. The T-columns 40 are used to join adjacent bins and each column comprises a cross-plate 40*a* and a center plate 40*b*, extending normal or at right angles to the cross-plate. The cross-plate 40*a* lies in a plane substantially parallel to the plane of the overall wall section 11*a*. The center plate 40*b* abuts the ends of the stringers 20 and serves as a cover for the stringers and also serves as a mounting point for the spacer members 24. The cross-plate 40*a* serves as a mounting for the stringers. As seen in FIG. 4, apertures 44 in the vertical flange portions 36*a* of the stringers are aligned with apertures 45 in the cross-piece 40*a* of the T-column and suitable fasteners such as bolts 43 (shown in FIG. 3) extend through and clamp the stringers to the cross-plate.

As seen in FIG. 4, the stringers 20 and spacers 24 are substantially similar in cross section. In particular, each spacer 24 includes a web 46 and outwardly extending legs 47 that diverge outwardly with respect to each other. Each leg 47 terminates in an L-shaped flange 48 having vertical and transverse portions 48*a*, 48*b*. The use of similar configurations for both structural members 20, 24 facilitates manufacture. However, since the loading experienced by the spacing members 24 during use is expected to be different than the loading on the stringer members, a different gauge of material may be used to construct the spacers. The invention, however, also contemplates alternate configurations for the spacers 24 that differ from the disclosed stringer configurations.

The spacers 24 are attached to the center plate 40*b* of the T-column. In the illustrated embodiment, vertical flange portions 48*a* of the spacers 24 include two or more apertures 49*a* which are aligned with apertures 49*b* formed in the center plate 40*b*. Bolts (not shown) fix the spacers to the T-column 40.

Turning now to FIG. 5, the construction and assembly of the corner of the rightmost bin 10*a* (shown and denoted in FIG. 1) in the center wall section 11*a* of the wall 10, is illustrated. The corner is defined by a vertical support column 50, substantially L-shaped in cross section including a narrow flange portion 50*a*, to which the stringers 20 are attached and a wider plate portion 50*b* that serves as a cover for the ends of the stringers 20 and also mounts the spacers 24. Suitable fasteners (not shown) extend through the stringer holes 44 and mounting holes 51 formed in the flange 50*a* and clamp the stringer to the corner column 50.

The corner assembly also includes a U-shaped channel 52 that acts as a cover for the ends of the spacers 24. As seen best in FIG. 5, vertical flange portions 48*a* of the spacers 24 are suitably attached to the inside of one of the legs 52*a* of the U-shaped channel. The channel 52 closes off the ends of the spacers to prevent soil leakage out of the bin.

In the preferred embodiment, mounting holes 54 in the leg 52*a* of the channel 52 and holes 49*a* in the vertical flange portions 48*a* of the spacers 24 are aligned with similarly configured apertures 55 in the cover plate 50*b* of the L-shaped corner column 50. Suitable fasteners extend through the apertures of all three members and clamp them together.

Turning now to FIG. 6, the construction and assembly of a corner of the lowest bin in the leg section 11*c* of the retaining wall (denoted by the circle 6 in FIG. 1), is shown. The assembly is substantially the same as that shown in FIG. 5 except that the members are rotated 90° from the position shown in FIG. 5. The corner construction includes the L-shaped column member 50 and the U-shaped channel 52 for covering the ends of the spacers 24. The L-shaped column 50 covers the ends of the stringers 20 whereas the U-shaped channel 52 covers the ends of the spacers 24 as explained above. FIG. 6, however, also illustrates a wall plate 56 that extends between and is fastened to the corners of the bins 10*a*, 10*b*. The wall plate, in effect, connects the center retaining wall section 11*a* to the leg sections 11*b*, 11*c*.

In particular one side of the wall plate 56 is fastened to the corner column 50 of the bin 10*b* by means of apertures 57 in the corner column 50 and associated aperture 58 formed in the wall plate. The other side of the wall plate is fastened to the corner column 50 of the bin 10*a* using the mounting holes 51 in the column 50 (shown in FIG. 5). As seen in both FIGS. 5 and 6, longitudinal angle members 59*a*, 59*b* are fastened to the uppermost stringers 20 and spacers 24 to reinforce the respective exposed flanges 36, 48.

In use, the bins 10 are back filled with earth or other material, thereby anchoring the overall wall in position. Returning to FIG. 3, the principle of the present invention will become apparent. When a bin is filled with anchoring material, the weight of the material exerts forces on the stringer members 20. The forces exerted on the stringer members include a horizontal component indicated by the vector arrow 60. This transverse force component is applied to the webs 34 of each stringer member. The forces applied to the web 34 or force receiving regions of the stringers urges the legs of each stringer apart. The legs of adjacent stringers are thus urged towards each other causing the transverse flange portions 36*b* to be driven into abutting contact thus establishing a soil tight interface between adjacent stringers. With the present invention, the anchoring material not only serves as a means for anchoring the overall bin in position, but also applies a force to the individual stringer members 20 urging adjacent legs into abutting, soil tight contact.

To enhance the overall abutting interface between the legs of adjacent stringers, as seen in FIG. 4, the transverse flange portions 36*b* include apertures 62 which are aligned during assembly and receive bolts or other fasteners to clamp the flanges 36 together at spaced locations. By clamping the flanges, at spaced locations, uneven forces applied to adjacent stringers will not produce vertical misalignment between the stringers.

As indicated above, in the preferred embodiment the spacers 24 are similarly configured. Like the stringers, the spacers include a web 46 that forms a force receiving region for transmitting spreading forces to the legs 47. This spreading force is of little consequence to those spacing members located intermediate the ends of the overall retaining wall since anchoring material is placed on both sides of the spacer members. However, the exposed spacer members 24 located at the ends of the wall can also utilize the forces induced by the anchoring material to cause a soil tight, abutting contact between the legs of adjacent spacers. It should be understood that, if the spacing wall (defined by spacers 24) is completely buried, spreading forces will not be generated. However in this situation, a soil tight interface between adjacent spacers is not needed. The flanges 48 of the spacers 24 may also include apertures 64 by which they can be bolted together to inhibit vertical misalignment. When a soil-tight interface is not needed between adjacent spacers 24, alternate configurations, not having soil-tight interface surfaces, can be employed and are contemplated by the present invention.

It should be apparent that a new and improved retaining wall construction is disclosed herein. Unlike prior art constructions, the present invention provides a retaining wall that does not require adjacent stringers to include overlapping portions to provide soil tightness. By relying on forces generated by the anchoring material to urge adjacent stringers into soil tight contact, cost savings can be realized in both material and labor without compromising the soil tightness of the wall.

Although the invention has been described with a certain degree of particularity, it should be understood that various changes can be made to it by those skilled in the art without departing from the spirit or scope of the invention as hereinafter claimed.

I claim:

1. A retaining wall for retaining earth or the like having at least one bin-type unit, the unit comprising:

(a) front and rear wall sections spaced apart by spacing means, said wall sections and spacing means defining a volume for receiving anchoring material;

(b) at least one of said front and rear wall sections including a plurality of longitudinal stringers, arranged in a side by side relationship and each extending between and fastened to a pair of upright members;

(c) each stringer being channel like in cross section and including a web defining a force receiving region and a pair of legs extending outwardly from said web, each of said legs defining an angle greater than 90° with respect to a plane defined by said force receiving region;

(d) each leg terminating in an angled flange, each flange being defined by a first portion extending outwardly from its associated leg in a direction away from a transverse center plane of said stringer, each flange further including a second portion extending from said first portion in a plane that intersects the plane defined by said force receiving region;

(e) each of said second flange portions defining an abutment surface for abuttably engaging an abutment surface defined by an adjacent stringer;

(f) said force receiving region of said stringer being adapted to receive forces generated by the anchoring material placed in said bin and operative to urge the legs of a stringer towards abutting engagement with the legs of adjacent stringers to enhance the soil retention at interfaces between abutting second flange portions of adjacent stringers.

2. The apparatus of claim 1 wherein each of said first flange portions is disposed in a plane parallel to the plane defined by said force receiving region of its web.

3. The apparatus of claim 1 wherein each of said second flange portions is disposed in a plane that intersects said force receiving plane of its web at substantially 90°.

4. The apparatus of claim 1 wherein each of said second flange portions defines an angle of 90° with respect to said first flange portion of the same flange.

5. The apparatus of claim 1 wherein said front and rear wall sections are comprised of stringers having similar cross sections.

6. The apparatus of claim 1 wherein said spacing means includes spacing members having a cross section similar to the cross section of said stringers.

7. A bin type retaining wall comprising:

(a) front and rear wall sections spaced apart by spacing members to define a volume for receiving anchoring materials;

(b) each of said wall sections comprising a plurality of longitudinal stringer members each extending between upright members, said stringers being arranged in side by side juxtaposed relationship;

(c) each stringer being hat-shaped in cross section and defined by a pair of legs extending outwardly from a web section, each web section defining a region for receiving a force generated by an anchoring material placed in the bin;

(d) each of said legs extending outwardly from its connected web section and defining an angle greater than 90° with respect to said connected web section and terminating in an L-shaped flange defined by a first portion that extends outwardly of its associated leg and that is disposed in a plane substantially coplanar with a plane defined by said web section, and a second flange portion extending toward the same side of its connected first portion as the said web section and defining an angle of substantially 90° with respect to the connected first flange portion;

(e) each of said second flange portions defining an abutment surface for abuttably engaging the second flange portion of an adjacent stringer; and, (f) the legs of a stringer being urged outwardly when in use by a force generated by said anchoring material and applied to said web so that abutment surfaces of adjacent stringers are urged together to define a substantially soil type engagement.

8. The apparatus of claim 7 wherein said wall comprises a plurality of said bin units joined together in a side by side relationship.

9. The apparatus of claim 7 wherein abutting second flange portions are fastened together at spaced locations to maintain alignment of said stringers and to establish an abutting relationship prior to back filling.

10. A retaining wall for retaining earth or the like having at least one bin-type unit, the unit comprising:

(a) front and rear wall sections maintained in spaced apart relationship by spacing means, said wall sections and spacing means defining a volume for receiving anchoring material;

(b) at least one of said front and rear wall sections including a plurality of longitudinal stringers, arranged in a side by side relationship and extending between and fastened to a spaced pair of upright members;

(c) each stringer being channel like in cross section and including a web defining a force receiving region and a pair of legs extending outwardly from said web, each of said legs defining an angle greater than 90° with respect to a plane defined by said web;

(d) each leg terminating in an associated flange extending from its leg and lying in a plane that intersects the plane defined by said web;

(e) each of said other flange portions defining an abutment surface for abuttably engaging an abutment surface defined by an adjacent stringer;

(f) said force receiving region of said stringer being adapted to receive forces generated by the anchoring material placed in said bin and being operative to urge the legs of a stringer towards abutting engagement with the legs of adjacent stringers to enhance the soil tight retention characteristics at each interface between the other flange portions of adjacent stringers.

* * * * *